United States Patent [19]

Ellison

[11] Patent Number: 4,662,840

[45] Date of Patent: May 5, 1987

[54] INDIRECT FIRED OVEN SYSTEM FOR CURING COATED METAL PRODUCTS

[75] Inventor: Kenneth Ellison, Brampton, Canada

[73] Assignee: Hunter Engineering (Canada) Ltd., Mississauga, Canada

[21] Appl. No.: 773,542

[22] Filed: Sep. 9, 1985

[51] Int. Cl.[4] ..... F26B 13/00; F27B 9/28

[52] U.S. Cl. ..... 432/8; 432/59; 432/72; 34/29; 34/34; 34/46; 34/54; 34/212; 34/242

[58] Field of Search ..... 34/26, 29, 34, 35, 46, 34/48, 54, 86, 155, 212, 215, 219, 242; 432/8, 59, 72

[56] References Cited

U.S. PATENT DOCUMENTS

| | | | |
|---|---|---|---|
| 2,810,662 | 10/1957 | Barnebey | 34/46 |
| 3,737,280 | 6/1973 | Cromp . | |
| 3,757,427 | 9/1973 | Wilkinson . | |
| 4,132,007 | 1/1979 | Voorheis | 34/35 |
| 4,206,553 | 6/1980 | Ellison . | |
| 4,217,091 | 8/1980 | Whike . | |
| 4,240,787 | 12/1980 | Jamaluddin . | |
| 4,326,342 | 4/1982 | Schregenberger . | |
| 4,343,769 | 8/1982 | Henkelmann | 34/26 |
| 4,575,952 | 3/1986 | Bodenan et al. | 34/54 |

*Primary Examiner*—William E. Wayner

*Assistant Examiner*—David W. Westphal

*Attorney, Agent, or Firm*—Donald E. Hewson

[57] ABSTRACT

An indirect fired oven system for curing coated products, particularly metal product such as coiled sheet steel or coiled sheet aluminum, is provided. The oven line comprises at least one oven zone though usually at least two or three zones are present, through which the coated product travels, and the oven line is operated at elevated temperatures. An indraft is induced at the entrance and exit ends of the oven line by a balance air fan which captures the indraft air at both ends almost immediately that it enters the oven line, and feeds part of the indraft air to a heat exchanger and then back to the oven zones, and part of it unheated directly back to the oven zones. The temperature in the oven zones is controlled by the influx to each zone of heated air. An exhaust fan is arranged to exhaust the oven zones including the volatile solvent released from the coating material as it heats up for curing in the oven; and the output from the exhaust fan is fed to an afterburner for combustion after which it flows through the heat exchanger and then to an exhaust stack. No products of combustion are therefore fed directly to the oven line or are in contact with the coated product as it moves through the oven.

20 Claims, 2 Drawing Figures

INDIRECT FIRED OVEN SYSTEM FOR CURING COATED METAL PRODUCTS

FIELD OF THE INVENTION

This invention relates to oven systems for curing coated products, such as coiled strip metal, but also other types of coated product such as fabric or a discrete articles, where the coating material is heat-curable and releases a volatile solvent while curing. In particular, this invention relates to an oven system which is indirect fired—i.e., where all combustion is carried out separate from the oven line, thereby so as to physically remove combustion products away from the oven line through which the coated product travels for curing, and therefore where no combustion products are in direct contact with the coated product as it moves through the oven line. The present invention also relates to an oven system whose operation, once established for any given set of conditions as to the coating material being used and as to the product being coated, is essentially self-stabilizing and self-controlled.

BACKGROUND OF THE INVENTION

There are a number of matters of general or particular concern in the design and operation of oven systems for curing coated products of all sorts. Oven systems are used for curing coated product such as fabric, coated discrete articles such as automobile or appliance parts which are carried through the oven by a conveyor, and even products such as coated wire or mesh. More particularly, coated coiled metal strip of steel or aluminum are cured in oven systems which may be very large and operate at high speeds and high temperatures, and in any event where the coating material is heat-curable and releases flammable or volatile solvent from the coated product as it travels through the oven line. Not only must the oven system be operated very safely, with no possibility of the buildup of a potentially explosive mixture within the oven, it must also be operated with reasonable cost efficiency and without contributing to environmental pollution.

Thus, it has long been realized that volatile solvent released from the coated product as it is being cured must be incinerated; and it has been recognized that if the volatile solvent is to be incinerated, then its heat contribution should be used for curing coated product which follows it through the oven.

It is also been well known that, in order to avoid any spillage of solvent and potentially explosive fumes from the oven, there must always be an indraft at both ends of the oven line.

This has created yet other problems, however. That is, if there is to be an indraft into the oven, which comprises a flow of cold air, and there is to be a flow of heated air into the oven line to maintain it at its elevated temperature, then the fan inducing that flow must handle a volume flow which is essentially twice the indraft volume at elevated temperatures; and the stack output is at very high temperatures. A typical oven schematic for such a system is discussed in greater detail hereafter.

Where a principal concern has been to provide a solvent free exhaust, WHIKE et al in U.S. Pat. No. 4,217,091 dated Aug. 12, 1980 have provided a method of dividing the over line into a plurality of zones in which solvents are vaporized and entrained, where recirculation of solvent-rich vapours from zone to zone is accomplished. That oven system, however, requires a number of zone incinerators, and a number of fans, thereby being a relatively high capital cost system.

JAMALUDDIN, in U.S. Pat. No. 4,240,787 issued Dec. 23, 1980, provides a similar kind of system, again requiring substantial capital cost and numerous zone incinerators and fans. A disadvantage of both of those systems, however, is the fact that combustion takes place directly within the ovens.

CROMP, in U.S. Pat. No. 3,737,280 issued June 5, 1973, has another approach where a number of burners, some of which are fuel fired and at least one of which is a solvent fired burner, are provided at the bottom of a stack. Some of the hot air exiting from the stack is diverted through the oven, mixed with fresh air, and some of the solvent-laden air coming off the oven is fed back to the solvent burner. The system of that patent reduces the fuel costs, but still requires considerable contribution by fuels other than solvent released from the coating material.

An oven line where both heated and cool gases are circulated to a plurality of oven chambers is that which is taught by SCHREGENBERGER in U.S. Pat. No. 4,326,342 issued Apr. 27, 1982. However, in this patent, the gas flow control is pressure related.

Another patent of interest is ELLISON et al U.S. Pat. No. 4,206,553, issued June 10, 1980. That patent teaches an oven and a method of operating the oven, where entrained vaporized solvent is removed from one or more oven zones but, rather than being fed off line to a separately disposed burner, they are fed to different oven zones where they are incinerated. Thereafter, the solvent-depleted vapours are fed to another zone and mixed with oven gases circulating in that zone so as to maintain a stable solvent vapour content and operating temperature in that other zone.

WILKINSON, in U.S. Pat. No. 3,757,427 issued Sept. 11, 1973, teaches an oven and a method of drying a solvent containing coating on the surface carried through the oven by exhausting the gases from the oven, and then splitting the exhaust into two streams, one of which is incinerated and the other of which is re-cycled directly back into the oven. One of the streams leaving the oxidizer or burner is vented to atmosphere, and the other is again passed into the oven together with the recycle stream of unburnt gases. In this system, some fresh air is drawn into the oven line, usually through a heat exchanger which is heated by the waste combustion gases, where the heated fresh air mixes with the incoming return stream of combustion gases, all for the purpose of maintaining safety limits and generally energy efficient operation.

BRIEF DISCUSSION OF THE INVENTION

In contradistinction to all of the prior devices and systems described above, the present invention provides an oven system where there is no product of combustion in contact with the coated product passing through the oven line. That is, the heated air which is introduced to the various zones along the oven line (in a multi-zone system) is heated in a heat exchanger, and does not directly pass over or through a zone combustion device and an oven zone on the same pass. On the other hand, it will also be noted that the air flow which passes through the oven system according to the present invention does so twice, as discussed in detail hereafter. On the first pass, the air flow—or some of it—may be heated by flowing past a heat exchanger but not directly through a combustion device, or it may be cool in the same sense as it was when it entered the oven line as indraft at either end of the oven line; and on the second pass, the air is solvent-laden (more or less), and is passed through an afterburner for combustion of the solvent, thence past a heat exchanger and finally to an exhaust stack or other heat recovery device.

Since the indraft is induced by a balance fan, the indraft becomes the heating medium for the oven. While that presents the major portion of the oven load, it will be seen very clearly hereafter that once the indraft is established in order for the oven operation to be balanced, it is necessary only to exhaust the same volume from the oven line as is being induced into the oven line as indraft volume. Indeed, very slightly higher volume may be exhausted than the induced indraft volume so as to ensure that the oven zone or zones are at slightly negative pressure with respect to the ambient from which the indraft volume is drawn.

The present invention contemplates that the combustion device in which the volatile and combustible solvent is burned is an afterburner which is usually physically removed away from the oven line, but which might in some conditions be installed within the oven line. In the latter event, the afterburner will function within the oven as a radiant heat source.

However, because no products of combustion are in direct contact with the coated product as it passes through the oven system for curing, spark possibilities are greatly reduced, as is the risk of flame exposure of the coated strip at the time that it is releasing solvent. Because all of the ventilating air forms indraft to the oven line, fume spillage is precluded; and usually, the indraft at least at the entrance end of the oven line comes from the coater room or area, so as to provide ventilation for that work space as well.

One of the principal features of the present invention is that the exhausted flow from the oven system is at a relatively low temperature compared with the working temperature, while at the same time the only area of high temperature operation is in the combustion chamber or afterburner itself. Moreover, because the indraft air is first circulated to the oven either heated or cooled in a controlled mixture, without having been in contact with any combustion operation, there is no oxygen depletion in the oven line, and the specific heat within the oven remains constant. Still further, the indraft volume does not function or tend to cool the oven zones, so that substantially full length heating operation is attained within the oven, and thereby maximum oven efficiency is achieved.

Another feature is that a more efficient operation is provided because the presence of an afterburner ensures a clean stack since all combustible solvent is burned before it is exhausted to the stack. A direct fired system would require additional means to ensure that there are no volatile and/or combustible products in the exhaust outflow from the oven line to the atmosphere.

BRIEF DESCRIPTION OF THE DRAWINGS

These and other features and advantages, and specifics of operation, are discussed in greater detail hereafter, in association with the accompanying figures of drawings, in which.

DESCRIPTION OF THE PREFERRED EMBODIMENTS

The description which follows is with respect to certain simplified but general schematics showing operation of oven systems which have substantially identical oven zone configurations and operating conditions. For the sake of discussion and example, and without purposes of limitation, the following discussion relates to oven systems which contemplate a steady or constant release of solvent for any given metal (or other coated product) and coating conditions, thereby requiring a minimum indraft so as to maintain the oven atmosphere at or below its design L.F.L. (Lower Flammable Limit) level. The L.F.L. is the steady operation limit at which the various flow settings of operating fans are established for maximum combustion efficiency and heat exchange, given the conditions of the solvent release within the oven at steady state conditions.

The present invention contemplates that the oven line will have at least one oven zone. As a practical matter, a single zone oven is usually operated at low speeds and generally low coated product throughput. A higher speed, higher output oven system with greater coated product throughput would more usually have at least two zones.

Figure 1:
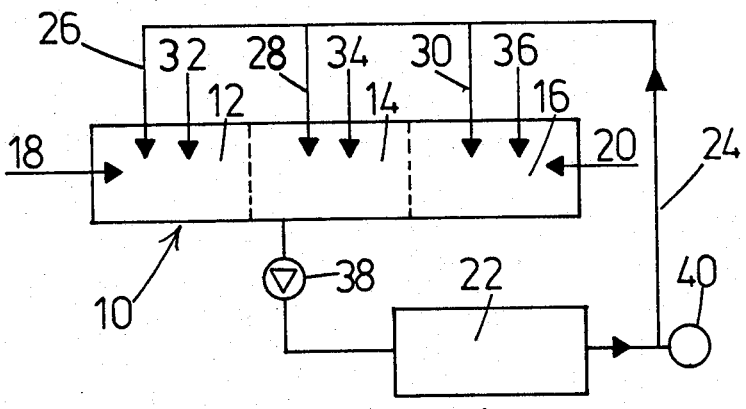
FIG 1 (PRIOR ART)
FIG. 1 is a simple schematic of a prior art oven system, showing certain advantages of operation but a number of disadvantages.
Figure 2:
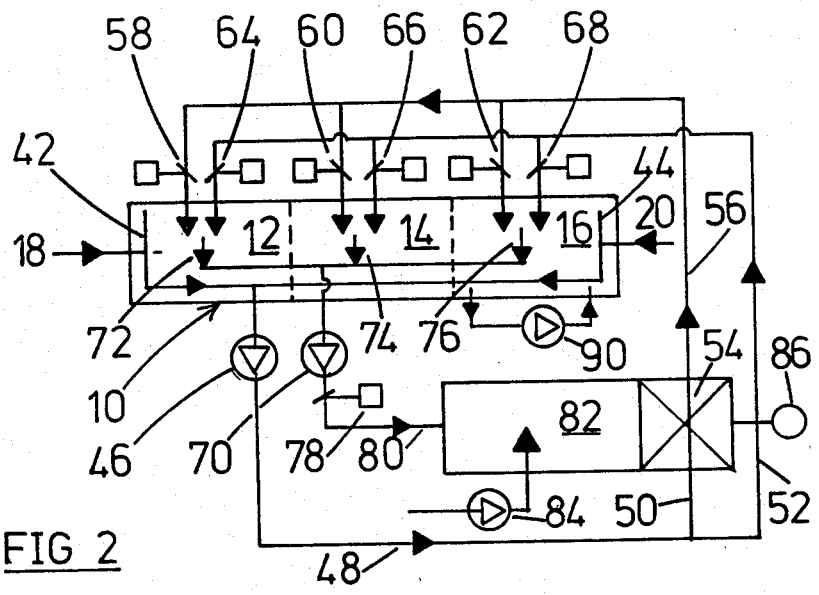
FIG. 2 is a simple schematic of an oven system according to the present invention.

There is shown in each of FIGS. 1 and 2 an oven line 10, each of which comprises—for the purposes of this discussion—three oven zones marked 12,14,16 in advancing order of the movement of the coated product (not shown) through the oven line 10. This is a relatively common configuration of a three-zone oven line, where the first zone 12 is a solvent release zone, in which the coating is heated and the solvent in which the coating material has been carried is released into the oven gases; the second zone 14 is a metal heat-up zone, where the metal of the coated product is heated up to reach an optimum temperature for curing the coating material on it; and the third zone 16 is a holding or dwell time zone where the metal is maintained at a constant temperature for purposes of curing the coating material. As noted, there may be fewer zones or other zones may be required; and often there will be a cooler zone beyond the exit end of zone 16.

It has been noted that the coated product whose coating is to be cured in an oven system according to this invention is one which is conveyable through the oven line. That could mean, for instance, that the product is in the nature of a web which is conveyable through the oven as it is suspended therein by its own tensile strength; or it could mean that the coated product may be conveyed through the oven on or suspended from a conveyor belt or line. Examples of the latter type of product could be any coated (such as dipped or sprayed) wire products, and other items such as automobile or appliance parts. Web or tensile products may be coated wire or wire mesh, or fabric; but most usually, the coated product is sheet metal such as coiled sheet steel or aluminum.

The following discussion is directed, for purposes of example to coated metal strip being cured in three zone ovens, and is particularly intended to demonstrate the principles and advantages of the present invention.

As an example, for metal strip travelling along through the oven line 10 at a speed of approximately 35 meters per minute, where each of the zones is in the order of six meters long, any point on the metal strip takes approximately ten seconds to move through each zone. By operating the zones at appropriate temperatures, the solvent release zone can substantially ensure release of most of the solvent within the first ten seconds that the coated metal is travelling through the oven line; the heat-up zone will ensure that the metal reaches its optimum temperature for curing the coating on it during the next ten seconds; and the curing of the coating material will be completed during the last ten seconds of dwell or travel time that the metal passes through the third zone.

As noted above, in either of the oven systems shown in FIGS. 1 and 2, there is an indraft at the entrance end of the first zone 12 and at the exit end of the last zone 16. The indraft flow is indicated at arrows 18 and 20; and especially in the system of FIG. 2 which is according to the present invention, the indraft can be balanced in any desired proportion. When, as is usual in keeping with the invention, the indraft 18 comes directly from the coater room or coater area which is at the upstream end of the oven line 10, the ratio of indraft volumes 18 and 20 may be in the order of 5:2, or otherwise as required.

It has been noted that, in a typical installation of the exemplary oven systems being discussed, each of the oven zones 12, 14 and 16 is approximately six meters in length. It is anticipated that the release of solvent from the coating material, and the amount of energy required to heat and maintain the oven line, may be substantially equivalent in terms of available thermal units of energy such as BTU's per hour, but there may be additional fuel requirements which are provided for especially in the system of FIG. 2 according to the present invention.

Moreover, the lower flammability limit (L.F.L.) of the system will determine the requisite amount of ventilating air to keep the L.F.L. at its set point; so that given a particular coated product flow through the oven line, having a particular coating, at a particular speed, the L.F.L. and therefore the ventilating air requirements as well as the heating and fuel requirements for the oven system may be determined.

The following discussion is particularly directed to oven systems which require an indraft of 7000 standard cubic feet per minute (SCFM), and assumes return of heated air to the oven line at about 970° to 1,000° F., with the average operating temperature of the oven line being in the order of 530° F., and with the air being exhausted from the oven line at about 500° F. It also assumes that the temperature of combustion—that is, the temperature of the air flow immediately as it leaves the afterburner—will be at 1400° F.

An oven system such as that shown in FIG. 1 uses a single source of combustion which is the afterburner 22, and thereby is an advance in the art over those prior systems which require the use of zone burners within the oven line. However, in the system of FIG. 1, the volume of flow through the afterburner 22 must be very high, and at high temperatures, for the following reasons:

First, the total indraft flow at 18 and 20 is 7000 SCFM for the oven line conditions being considered. However, the heating requirement of the three zones requires hot recycle flow in line 24 after the afterburner 22, to the oven recycle inputs 26,28,30 so that the oven zones are at an average temperature of 530° F. and with a total flow rate of 4842 SCFM. (Provision is also made for ventilating air into each of the oven zones at 32,34,36 for controlling the L.F.L.; but in the usual case, that flow is zero SCFM when the oven is operating with anticipated solvent release and combustion.)

Thus, the fan 38 in the oven line system of FIG. 1 is required to handle 11,842 SCFM (7000+4842); and all of that flow must be heated and raised from approximately 500° F. to 1400° F. in the afterburner 22.

Assuming average oven line temperature of 530° F. with cold indraft flow, the flow in recycle line 24 of 4,842 SCFM is at approximately 1400° F., with the moxed oven gases drawn from the oven line 10 by fan 38 being at 500° F.

Moreover, it is evident that 7000 SCFM must be exhausted from the stack 40 at 1400° F.

[The final exit temperature of air flowing from the stack 40 may, indeed, be less than 1400° F. if, for example, a pre-heat exchanger for preheating the outflow from fan 38 is used. In those conditions, the oven stack output temperature might be reduced to as low as 1000° F. In any event, however, there is still the requirement for the afterburner to heat a total of 11,842 SCFM; and there is also the requirement that the fan 38 must exhaust both the inflow 18,20 and the recycle flow 26,28,30 as well as any ventilating air 32,34,36 from the oven line 10.]

Turning now to the oven system of FIG. 2, which is particularly in keeping the present invention, the same oven line 10 is shown.

The operating conditions of the oven system of FIG. 2 are essentially the same as those of FIG. 1; that is, an indraft flow of 7,000 SCFM is assumed, afterburner operation at 1400° F. is designed for, and operation in the oven line at 530° F. is designed for.

However, the oven system of FIG. 2 provides several particular advantages, and as well it contemplates the use of an additional fuel or start-up fuel in the afterburner, with bypass of the afterburner of volume flow which does not need to be heated. Also, the afterburner may be physically removed from the oven line; or it may be built into the oven but in such a manner that it is separated from the product that is passing through the oven.

The particular similarity of the oven systems of FIG. 1 and FIG. 2 is that each of the oven systems is a system where there is a single source of combustion—the afterburner—that is separate from the oven line, and where there is substantially full contribution of the solvent heat energy because all of the solvent-rich fumes from the oven are directed to the afterburner for combustion.

Once again, the indraft at 18 and 20 is at a total flow of 7,000 SCFM; however, in this case, the indraft is captured at ports 42 and 44, so that the ports 42 and 44 exhaust substantially all of the indraft air 18 and 20 almost immediately that it enters the entrance end of the first oven zone 12 and the exit end of the last oven zone 16. A balance air fan 46 thereby induces the indraft 18,20, and the output of the balance fan 46 at 48 is split into two lines 50 and 52. The first line 50 passes through a heat exchanger 54 and thence is returned on recycle line 56 to each of the oven zones 12,14,16. The flow of the recycle air from line 56 is controlled into each of the oven zones 12,14,16 by an oven zone temperature controller operating an associated damper, as indicated respectively at 58,60,62. The other portion of the indraft air through return line 52 is directed in an unheated volume flow back to the oven line for distribution to the oven zones 12,14,16 as controlled by respective oven zone ventilation controllers operating dampers as shown at 64,66,68 respectively.

The flow through the balance fan 46 is, in the general example being considered, 7,000 SCFM; and assuming the oven exhaust temperature under steady state conditions to be 500° F. the flow in the recycle line 50 passed the heat exchanger 54 is 4,740 SCFM, with the unheated return flow through the recycle line 52 being 2,260 SCFM. The flow through exhaust fan 70 is also 7,000 SCFM (which, on observation, is the total flow through lines 50 and 52 as well as the total flow at 18 and 20); or it may be slightly higher, thereby creating a slight negative unbalance in one or more of the oven zones where the pressure may be negative with respect to the ambient outside of the oven line. The exhaust fan 70 captures the oven fumes at oven vents 72, 74, 76; and is under control at least in the start-up of the oven line operations of an oven exhaust volume control unit 78 which has its associated damper in the output line 80 from the exhaust fan 70. The output line 80 is fed to the afterburner 82.

In circumstances such as in start-up when a flame front is necessary to ignite the combustible solvent as it enters the afterburner, and perhaps other operating conditions where the solvent fuel contribution does not quite meet the heating requirements, an additional fuel may be fed to the afterburner 82. That additional fuel may require additional combustion air, which is fed to the afterburner 82 by combustion fuel fan 84. Assuming that the additional fuel may be such as oil or coal tar fuel (CTF), the additional combustion air flow that is required may be in the order of 715 SCFM. [Other fuels such as natural gas or liquified petroleum gas (LPG) may be used, which do not require any additional combustion air.]

Thus, it will be seen that each of the balance fan 46 and the exhaust 70 is handling a volume flow of approximately 7,000 SCFM; however, the air being handled by the balance fan 46 is cool—substantially room temperature—whereas that which is handled by the exhaust fan 70 is at 500° F. in steady state oven operating conditions. More particularly, however, it will be noted that the volume flow through the afterburner 82 is 7,000 SCFM or, at the most, 7,715 SCFM, so that only that volume flow is required to be raised in temperature from 500° F. to 1400° F. Because of the operation of the heat exchanger 54, the temperature of the flow when it reaches the stack 86 is only 545° F.

In the oven system of FIG. 2, it is seen that the indraft flow 18,20 becomes the heating medium for the oven line, and it becomes the major portion of the oven load. However, in order to balance that flow, it is necessary for the exhaust fan only to pull 7,000 SCFM from the oven, (or slightly more if a slight negative unbalance is desired) so when steady state oven operation is attained the ongoing operation of the oven is essentially self-controlled.

Obviously, as the solvent load in the oven increases due to a change of solvent or a slow down of the metal strip as it passes through the oven, the indraft requirement will also increase because it is the indraft air which provides the ventilating air to maintain the L.F.L. for the oven. As the indraft flow increases, especially in the usual operating circumstances of the present invention, the ventilation of the coater room area will also increase.

Because all of the indraft air is fresh air, it will be noted that a constant oxygen content of recycle ventilating air is maintained in the oven line, at 21% (atmospheric concentration) at all times. Since there is no source of ignition in the oven, because there is no combustion directly in the oven, an inherently safe operation is assured.

By the same token, because there is no combustion directly within the oven, and the recycled air which is fed to the oven is on the first pass of the indraft air either unheated or through the heat exchanger, there are no products of combustion which come into contact with the coated product as it passes through the oven and also there is much less dust build-up within the oven. Because there is full contribution of the solvent heat energy as it is released from the coated product within the oven, the oven system is energy efficient.

It will also be noted that, because the indraft air 18,20 is captured substantially at the time that it enters the oven line—which it must do in order to preclude fume spillage from within the oven zones 12 and 16, as illustrated, to the outside of the oven line—substantially the entire lengths of the oven zones 12 and 16 as illustrated are used, thereby providing full length heating efficiency within the oven.

A brief description follows as to the start-up of the oven system of FIG. 2. This description assumes a coiled sheet metal as the coated product; but of course, other coated products as discussed above may be used, with appropriate adjustments and the provision of a conveyor, if necessary.

To begin with, all of the fans are operated so as to purge the oven line for a period of time. Thereafter, the afterburner 82 is lit, and burning of the fuel (initially, a feeder fuel such as LPG or CTF) at the afterburner is established. Because, at that time, there is no solvent load in the oven, a low exhaust volume (4,500 SCFM) may be established.

Then, with no load, the oven zone ventilation dampers which are part of controls 64, 66, 68 are closed, and the other dampers 58, 60, 62 are fully opened. That condition remains until the zone temperatures that are set for each zone 12, 14, 16, are obtained, and then the controllers take over to modulate and maintain the respective zone temperature settings as required. It has been previously noted that the temperature in each zone may be somewhat different, to accommodate solvent release requirements in the first zone, metal heat-up requirements in the second zone and metal temperature maintenance requirements in the third zone.

The start-up procedure continues by obtaining and maintaining afterburner temperature 1400° F., with the heated balance air in recycle line 56 being maintained at about 970° F.

Now, the oven operation may begin with the zone temperatures and the L.F.L. for each zone being set and determined, having in mind the operating conditions such as the metal to be fed through the oven (strip steel or aluminum, for example) its thickness and width, the nature and thickness of the coating on the metal, and whether the metal is coated on both sides of just one side. The exhaust volume of 7,000 SCFM is established for fan 70; and as night strip is run out of the oven so as to draw in the strip which is to be processed, some modulation may occur. As the coated strip begins to enter the oven, and the solvent load in the oven increases, the L.F.L. controllers will operate to open the dampers 64, 66, 68 as required; and that will tend to cause a reduction in the zone temperatures thereby causing the dampers 58, 60, 62 to open and modulate to maintain the preset oven zone temperatures.

Other specific settings and control operations are bdyond the scope of the present invention; however, the above discussion has been intended to illustrate the manner in which safe, energy efficient oven line operation can be attained with low temperature stack output.

As noted, specific illustrations as to operating conditions, temperatures and air flow volumes, have been given for purposes of illustration only, and are not to be considered to be limitations to the present invention. It has been noted that the oven line may comprise as few as one oven zone, or more than three oven zones. Moreover, a cooler zone may be added to the end of the oven line beyond the exit end of the last oven zone.

It is also possible that recirculation fans such as that which is shown at 90 with respect to oven zone 16, may be added to the system, for additional control purposes. Usually, in that case, the recirculation fan is positioned in any zone for purposes of recirculating the zone air in that zone to the coated metal strip as it passes through the zone.

The operation of an indirect fired oven system, as discussed and described above, contributes a better efficiency and may permit a lower capital cost. Moreover, because there is usually a requirement that is at least imposed by local or other government authorities that there should be no (or a very low level of) combustible and/or volatile components in the exhaust stack effluent, for purposes of protection of the environment, the afterburner will provide the means to satisfy that requirement.

In those circumstances when the solvent volume from the oven line to the afterburner is so large, as compared to the Basic Oven Load requirements, that over-heating of the afterburner may occur, provision is made to increase the oven exhaust volume. There is also, of course, a high limit temperature controller for the afterburner which, if acuated, will shut down the oven and the afterburner, and retreat the coater heads from the moving strip (or otherwise stop the application of coating material) so as to reduce or eliminate the solvent input to the afterburner.

Also, in cases where the solvent input to the afterburner is low and combustibles analysers are not considered necessary, the maximum volume of balance air (heated and unheated) for each zone is independently pre-set using the heated air and cool air dampers to that zone. The dampers are then connected to be driven by a single motor having a cross-connected linkage to them, so that the motor operating the dampers closes one and opens the other in response to changes in temperature within the zone. Thus, the ventilation in that zone remains constant despite zone temperature changes. This fixed ventilation at all times may preclude the necessity for combustible analysers in the circumstances when the ventilation volume is no greater than the combustion air requirements—i.e. the balance air input—of the maximum possible solvent input at which the oven system can be operated without fume spillage from the entrance and/or exit ends of the oven line.

An indirect fired oven system for curing coated products has been disclosed, both in generalities and with reference to certain specific operating conditions, as well as a method of curing the coating on a coated product by passing that coated product through an oven line according to and in keeping with the steps taught by the present invention. The scope of the invention is more particularly defined by the appended claims.

I claim:

1. A method of curing a heat-curable solvent releasing coating material on a coated product, comprising the steps of:

continuously feeding the coated product through an oven line having at least one oven zone operated at elevated temperature;

operating a balance air fan to create an indraft of cool air into the entrance and exit ends of said oven-line, where substantially all of said indraft air is drawn from near said respective entrance and exit ends by said balance air fan;

directing the output of said balance air fan in a first volume to a heat exchanger for heating, and thence by return to said oven line for distribution to said at least one oven zone, and in a second unheated volume back to said oven line for distribution to said at least oven;

operating an exhaust fan adapted to withdraw air from said oven line in a third volume substantially equal to the total of said first and second volumes, and directing the output of said exhaust fan to an afterburner for burning all the volatile solvent carried in said third volume, which is then directed to said heat exchanger, and thence to an exhaust stack;

where the principal fuel souce for said afterburner is the volatile solvent released from said coating material on said coated product as it travels through said oven zones.

2. The method of claim 1, where said oven line comprises at least two zones, each of which is operated at elevated temperatures; and said entrance and exit ends of said oven line are at the entrance and exit ends of the first and last of said at least two zones, respectively.

3. The method of claim 2, where said coated product is metal strip.

4. The method of claim 2, including the further step of providing an additional input flow of combustion air to said afterburner in sufficient quantity for combustion of an additional fuel; and adding said additional combustion air flow to the output from said exhaust stack.

5. The method of claim 2, where the temperature of each of said oven zones is controlled by the respective operation of dampers controlling the total flow into said oven line of the output from said balance air fan.

6. The method of claim 5, where the distribution of said first and second flow volumes which comprise the output flow of said balance fan, to each oven zone, is controlled by respective oven zone temperature dampers and oven zone ventilation dampers.

7. An indirect fired oven system for curing coated product which is moved in a continuing manner through said oven and is coated with a heat-curable, solvent releasing coating material, comprising:

an oven line having at least one oven zone through which the coated product is arranged to travel, which zone is operated at elevated temperatures;

the entrance and exit ends of said oven line each having means to exhaust substantially all indraft air entering said entrance and exit ends at a position near each respective end;

a balance air fan connected to said means to exhaust, and adapted to direct its output flow in a first volume flow to a heat exchanger for heating, and thence back to said oven line for distribution to said at least one oven zone, and in a second unheated volume flow to said oven line for distribution to said at least one oven zone;

an exhaust fan adapted to withdraw air from said oven and to direct its output in a third volume flow to an afterburner and thence past said heat exchanger and to an exhaust stack;

where the principal fuel source for said afterburner is the volatile solvent released from said coating material on said coated product as it travels through said oven;

and where the sum of said first and second volume flows drawn by said balance air fan from said oven line substantially equals said third volume flow drawn by said exhaust fan from said oven line.

8. The oven system of claim 7, where the flow of air at least into said entrance end is from a coater area where said coating material is applied to said product.

9. The oven system of claim 7, where said coated product is in the nature of a web, and is conveyable by its own tensile strength suspended in said oven.

10. The oven system of claim 7, where said coated product is a plurality of discrete articles which are carried through said oven by a conveyor.

11. An indirect fired oven system for curing coated product which is moved in a continuing manner through said oven and is coated with a heat-curable, solvent releasing coating material, comprising:

an oven line having at least two oven zones arranged in line, through which the coated product is arranged to travel, which zones are operated at elevated temperatures;

the entrance and exit ends of the first and last of said at least two zones, respectively each having means to exhaust substantially all indraft air entering said entrance and exit ends at a position near each respective end;

a balance air fan connected to said means to exhaust, and adapted to direct its output flow in a first volume flow to a heat exchanger for heating, and thence back to said oven line for distribution to said oven zones, and in a second unheated volume flow to said oven line for distribution to said oven zones;

an exhaust fan adapted to withdraw air from said oven and to direct its output in a third volume flow to an afterburner and thence past said heat exchanger and to an exhaust stack;

where the principal fuel source for said afterburner is the volatile solvent released from said coating material on said coated product as it travels through said oven zones;

and where the sum of said first and second volume flows drawn by said balance air fan from said oven line substantially equals said third volume flow drawn by said exhaust fan from said oven line.

12. The oven system of claim 11, where said afterburner is equipped for burning an additional fuel which requires an additional input flow of combustion air sufficient for combustion of said additional fuel;

and the exhaust stack flow is augmented by the amount of said additional combustion air.

13. The oven system of claim 11, where the coated product is metal strip.

14. The oven system of claim 13, where the flow of air at least into the entrance end of the first oven zone is from a coater area where said coating material is applied to said strip.

15. The oven system of claim 13, where there are three oven zones, the first of which in order of flow through said zones of said coated metal strip is the zone in which most of the volatile solvent is released from said coating material; the second zone being that in which the coated metal strip is heated to its optimum temperature for curing said coating material; and the third zone being that in which the coated metal strip is maintained substantially at said optimum temperature for a dwell period while said metal strip travels through said third zone, so as to continue the curing operation of said coating material.

16. The oven system of claim 15, where the oven zones are all of substantially equal size.

17. The oven system of claim 15, where the temperature of each of said oven zones is controlled by the respective operation of dampers controlling the total flow into said oven line of the output from said balance air fan.

18. The oven system of claim 17, where the temperature of each oven zone is controlled by oven zone temperature dampers; one for each zone, which control all of said first volume flow of heated air from said heat exchanger into each respective oven zone; and by oven zone ventilation dampers, one for each zone, which control all of said second unheated volume flow into each respective oven zone.

19. The oven system of claim 18, where at least one oven zone contains a recirculation fan for recirculating zone air in that respective zone to said coated metal strip.

20. The oven system of claim 11, further comprising an air cooler zone beyond the exit end of said last oven zone.

* * * * *